US010373539B2

(12) United States Patent
Kim et al.

(10) Patent No.: US 10,373,539 B2
(45) Date of Patent: Aug. 6, 2019

(54) POWER SUPPLY UNIT AND DISPLAY DEVICE INCLUDING THE SAME

(71) Applicant: LG Display Co., Ltd., Seoul (KR)

(72) Inventors: Seunghwan Kim, Goyang-si (KR); Young Sun Kim, Gwangju (KR)

(73) Assignee: LG Display Co., Ltd., Seoul (KR)

( * ) Notice: Subject to any disclaimer, the term of this patent is extended or adjusted under 35 U.S.C. 154(b) by 51 days.

(21) Appl. No.: 15/684,467

(22) Filed: Aug. 23, 2017

(65) Prior Publication Data

US 2018/0061294 A1 Mar. 1, 2018

(30) Foreign Application Priority Data

Aug. 31, 2016 (KR) ..... 10-2016-0112185

(51) Int. Cl.
*G09G 3/36* (2006.01)
*G09G 3/00* (2006.01)

(52) U.S. Cl.
CPC ..... *G09G 3/006* (2013.01); *G09G 3/367* (2013.01); *G09G 3/3696* (2013.01); *G09G 3/3614* (2013.01); *G09G 3/3688* (2013.01); *G09G 2310/027* (2013.01); *G09G 2310/0289* (2013.01); *G09G 2310/0291* (2013.01); *G09G 2310/08* (2013.01); *G09G 2330/026* (2013.01); *G09G 2330/12* (2013.01)

(58) Field of Classification Search
CPC ..... G09G 3/006; G09G 3/367; G09G 3/3696; G09G 3/3614; G09G 3/3688; G09G 2310/027; G09G 2310/0289; G09G 2310/0291; G09G 2310/08; G09G 2330/026; G09G 2330/12
See application file for complete search history.

(56) References Cited

U.S. PATENT DOCUMENTS 4,327,319 A * 4/1982 Swisher ..... G05F 1/468 323/275
2007/0035533 A1* 2/2007 Kim ..... G09G 5/006 345/204
2013/0093742 A1* 4/2013 Lin ..... G09G 3/3688 345/211
2014/0143560 A1* 5/2014 Kwon ..... G06F 1/30 713/300
2016/0087627 A1* 3/2016 Jang ..... H03K 17/6871 345/214

* cited by examiner

*Primary Examiner* — Mark Edwards
(74) *Attorney, Agent, or Firm* — Seed Intellectual Property Law Group LLP

(57) ABSTRACT

Disclosed are a power supply unit and a display device including the same, which prevent a source drive IC from being damaged by a supply reversal between a VDD voltage and an HVDD voltage. The power supply unit may include a first voltage generator that generates a first voltage and a first voltage line connected to the first voltage generator for supplying the first voltage to a plurality of first source drive ICs of the display panel. A second voltage generator is included that generates a second voltage, and a second voltage line is connected to the second voltage generator for supplying the second voltage to a plurality of second source drive ICs of the display panel. The power supply unit may further include a diode circuit that includes at least one diode connected between the first voltage line and the second voltage line.

20 Claims, 5 Drawing Sheets

POWER SUPPLY UNIT AND DISPLAY DEVICE INCLUDING THE SAME

CROSS-REFERENCE TO RELATED APPLICATIONS

This application claims the benefit of the Korean Patent Application No. 10-2016-0112185 filed on Aug. 31, 2016.

BACKGROUND

Technical Field

The present disclosure relates to a power supply unit and a display device including the same.

Description of the Related Art

With the advancement of information-oriented society, various requirements for display devices for displaying an image are increasing. Therefore, various display devices such as liquid crystal display (LCD) devices, plasma display panel (PDP) devices, organic light emitting diode display devices, etc., are being used recently.

The display devices include a display panel, a gate driver, a data driver, a timing controller, and a power supply unit. The display panel includes a plurality of data lines, a plurality of gate lines, and a plurality of pixels which are respectively provided in a plurality of areas defined by intersections of the data lines and the gate lines and are supplied with data voltages of the data lines when gate signals are supplied to the gate lines. The pixels emit light having certain brightness according to data voltages. The gate driver supplies the gate signals to the gate lines. The data driver includes a source drive integrated circuit (IC) which supplies the data voltages to the data lines. The timing controller controls an operation timing of the gate driver and an operation timing of the data driver. The power supply unit supplies voltages necessary for driving of the gate driver, the data driver, and the timing controller.

The source drive IC is provided in plurality, and the plurality of source drive ICs each include a shift register, a latch, a digital-analog converter (DAC), and an output buffer. The output buffer includes a plurality of positive output circuits, which output positive data voltages, and a plurality of negative output circuits which output negative data voltages. The positive data voltages are high data voltages with respect to a common voltage, and the negative data voltages are low data voltages with respect to the common voltage. The positive output circuits and the negative output circuits receive, as driving voltages, a VDD voltage, a VSS voltage lower than the VDD voltage, and a half VDD (HVDD) voltage between the VDD voltage and the VSS voltage.

Recently, as consumer demand increases, 60 or more inches large screen display devices are being released. In large screen display devices, a consumption current considerably increases due to the VDD voltage which is a driving voltage of the source drive IC. A maximum output current of a VDD voltage generator which generates the VDD voltage is limited, and for this reason, in the large screen display devices, it is difficult that the power supply unit is configured to include the VDD voltage generator. Therefore, in the large screen display devices, the power supply unit may include a plurality of VDD voltage generators, for example, a first VDD voltage generator and a second VDD voltage generator. Also, the power supply unit may include an HVDD voltage generator which generates the HVDD voltage from one of a first VDD voltage of the first VDD voltage generator and a second VDD voltage of the second VDD voltage generator.

As in FIG. 1, for stable driving, when power is input, the source drive IC is supplied with the VDD voltage, and then, is supplied with the HVDD voltage. However, when the power is input, due to a difference between a VDD voltage increase time of the first VDD voltage generator and a VDD voltage increase time of the second VDD voltage generator, the VDD voltage can be supplied later than the HVDD voltage to the source drive IC. For example, in a case where the HVDD voltage is generated from the first VDD voltage, if an increase time of the second VDD voltage is slower than an increase time of the first VDD voltage, a supply reversal between the VDD voltage and the HVDD voltage can occur in the source drive IC. The source drive IC can be damaged due to the supply reversal between the VDD voltage and the HVDD voltage.

BRIEF SUMMARY

Accordingly, the present disclosure is directed to provide a power supply unit and a display device including the same that substantially obviate one or more problems due to limitations and disadvantages of the related art.

An aspect of the present disclosure is directed to provide a power supply unit and a display device including the same, which prevent a source drive IC from being damaged by a supply reversal between a VDD voltage and an HVDD voltage.

According to one example, a power supply unit for a display device is provided, including a first VDD voltage generator for generating a first VDD voltage, a first VDD voltage line connected to the first VDD voltage generator for supplying the first VDD voltage to a plurality of first source drive ICs of the display panel, a second VDD voltage generator for generating a second VDD voltage, a second VDD voltage line connected to the second VDD voltage generator for supplying the second VDD voltage to a plurality of second source drive ICs of the display panel and a diode circuit including p diodes, p being an integer equal to or greater than one, the diode circuit being connected between the first VDD voltage line and the second VDD voltage line and configured to allow a current flow from the first VDD voltage line to the second voltage line, if a difference between the first VDD voltage of the first VDD voltage line and the second VDD voltage of the second VDD voltage line is greater than a predetermined voltage. The plurality of first source drive ICs and the plurality of second source drive ICs may be different from each other. Thus, if an initial increase of the second VDD voltage is slower than an initial increase of the first VDD voltage, the second VDD voltage line is charged via the diode circuit, thereby leading to a delayed supply at the source drive ICs. Thus, a rather simultaneous supply of the first or second VDD voltage can be ensured.

The power supply unit may further comprise a HVDD voltage generator for generating a HVDD voltage and a HVDD voltage line connected to the HVDD voltage generator for supplying the HVDD voltage to the first and the second source drive ICs of the display panel. The first VDD voltage and the second VDD voltage may have a voltage level higher than the HVDD voltage. The voltage level of the HVDD voltage may be equal to or larger than a minimum voltage level of a positive data voltage and equal to or smaller than a maximum voltage level of a negative data voltage. The HVDD voltage generator may be connected to the first VDD voltage line. The HVDD voltage generator may be configured to generate a HVDD voltage using the first VDD voltage. In this case, it can be prevented that the second VDD voltage is supplied to the second source drive ICs only after the HVDD voltage is supplied thereto, thereby preventing a voltage reversal causing damage to the second source drive ICs.

The predetermined voltage may be a threshold voltage of the diode. The diode circuit may include at least two diodes, $p \geq 2$, serially connected to each other. In the diode circuit, an anode electrode of the diode may be electrically connected to the first VDD voltage line and a cathode electrode of the diode may be electrically connected to the second VDD voltage line.

The power supply unit may further comprise a short circuit detector connected to the first VDD voltage line and configured to output a short circuit detection signal indicating whether a voltage level of the first VDD voltage is less than a predetermined voltage level. The power supply unit may further comprise a voltage output controller configured to control the first and second VDD voltage generators based on the short circuit detection signal. If the voltage level of the first VDD voltage is less than the predetermined voltage level, the first and second VDD voltage generators may be controlled not to output the first and second VDD voltages. Also, the voltage output controller may control all voltage generating units of the power supply unit not to output a voltage.

The first and/or second VDD voltage generator may include a boost IC. The HVDD generator may include a buck converter.

According to another example, a display device is provided, including a display panel including a plurality of pixels, a power supply unit according to any one of the preceding examples, and a data driver including the plurality of first and second source drive ICs. The display panel may include a plurality of gate lines and a plurality of data lines crossing each other for defining the plurality of pixels. The source drive ICs may be configured to output data voltages to the plurality of data lines.

The source drive ICs may include, respectively, an output buffer including at least one positive output buffer for outputting a positive data voltage and at least one negative output buffer for outputting a negative data voltage. One of the first and second VDD voltages may be input to a first reference voltage terminal of the positive output buffer. The HVDD voltage may be input to a second reference voltage terminal of the positive output buffer.

According to a further example, a display device is provided, including a first VDD voltage generator for generating a first VDD voltage, a first VDD voltage line connected to the first VDD voltage generator for supplying the first VDD voltage to a plurality of first source drive ICs of the display panel, a second VDD voltage generator for generating a second VDD voltage, a second VDD voltage line connected to the second VDD voltage generator for supplying the second VDD voltage to a plurality of second source drive ICs of the display panel, a short circuit detector connected to the first VDD voltage line and configured to output a short circuit detection signal indicating whether a voltage level of the first VDD voltage is less than a predetermined voltage level, and a voltage output controller configured to control the first and second VDD voltage generators based on the short circuit detection signal. If the voltage level of the first VDD voltage is less than the predetermined voltage level, the first and second VDD voltage generators may be controlled not to output the first and second VDD voltages.

According to another example, a power supply unit comprises a first VDD voltage generator configured to generate a first VDD voltage to output the first VDD voltage to a first VDD voltage line; a second VDD voltage generator configured to generate a second VDD voltage to output the second VDD voltage to a second VDD voltage line; a diode circuit between the first VDD voltage line and the second VDD voltage line, the diode circuit including at least one diode; and a power controller including an HVDD voltage generator configured to generate an HVDD voltage using the first VDD voltage applied from the first VDD voltage generator to output the HVDD voltage to an HVDD voltage line.

An anode electrode of the at least one diode may be coupled to the first VDD voltage line, and a cathode electrode is coupled to the second VDD voltage line. The at least one diode may comprise a general diode, a Schottky barrier diode, or a combination thereof. The power controller may further comprise a short circuit detector configured to output a short circuit detection signal having a first logic level voltage when the first VDD voltage of the first VDD voltage line may be lowered to a threshold voltage level or less. The power controller may further comprise a voltage output controller configured to output a voltage output control signal so that the first and second VDD voltage generators do not output voltages when the short circuit detection signal having the first logic level voltage is input.

According to a further example, a display device comprises a display panel including a plurality of data lines, a plurality of gate lines, and a plurality of pixels connected to the plurality of data lines and the plurality of gate lines; a plurality of source drive integrated circuits (ICs) configured to convert digital video data into data voltages and apply the data voltages to the plurality of data lines; a gate driver configured to apply gate signals to the plurality of gate lines; and a power supply unit configured to apply a first VDD voltage and an HVDD voltage to some of the plurality of source drive ICs and apply a second VDD voltage and the HVDD voltage to the other source drive ICs, wherein the power supply unit comprises a first VDD voltage generator configured to generate the first VDD voltage to output the first VDD voltage to a first VDD voltage line; a second VDD voltage generator configured to generate the second VDD voltage to output the second VDD voltage to a second VDD voltage line; a diode circuit including at least one diode, the diode circuit allowing a current to flow from the first VDD voltage line to the second VDD voltage line; and a power controller including an HVDD voltage generator configured to generate the HVDD voltage from the first VDD voltage applied from the first VDD voltage generator to output the HVDD voltage to an HVDD voltage line.

Some of the plurality of source drive ICs may be coupled to the first VDD voltage line, and the other source drive ICs may be coupled to the second VDD voltage line. The plurality of source drive ICs may be coupled to the HVDD voltage line. In the power supply unit, an anode electrode of the at least one diode may be coupled to the first VDD voltage line, and a cathode electrode may be coupled to the second VDD voltage line. The at least one diode may comprise a general diode, a Schottky barrier diode, or a combination thereof. The power controller may further comprise a short circuit detector configured to output a short circuit detection signal having a first logic level voltage when the first VDD voltage of the first VDD voltage line is lowered to a threshold voltage level or less. The power controller may further comprise a voltage output controller configured to output a voltage output control signal so that the first and second VDD voltage generators do not output voltages when the short circuit detection signal having the first logic level voltage is input.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
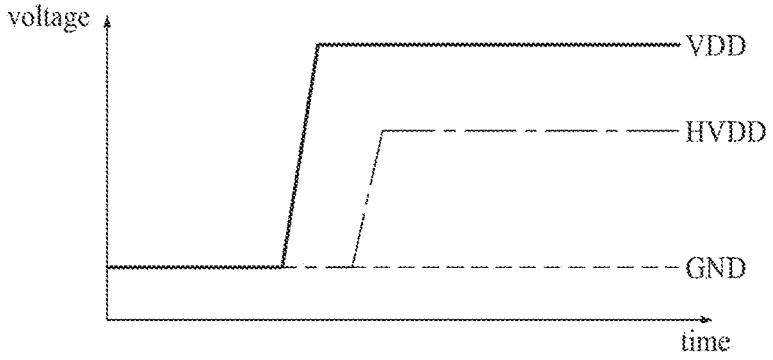
FIG. 1 RELATED ART
FIG. 1 is a waveform diagram illustrating an order in which a VDD voltage and an HVDD voltage are supplied to a source drive IC.

Reference will now be made in detail to the exemplary embodiments of the present disclosure, examples of which are illustrated in the accompanying drawings. Wherever possible or convenient for describing the various embodiments provided herein, the same reference numbers will be used throughout the drawings to refer to the same or like parts.

In the following description, the detailed description of well-known functions, features or configurations may be omitted where inclusion of such description may otherwise obscure the description of the various embodiments of the present disclosure. The terms described in the specification should be understood as follows.

Advantages and features of the present disclosure, and implementation methods thereof will be apparent from the following exemplary embodiments described with reference to the accompanying drawings. The present disclosure may, however, be embodied in different forms and should not be construed as limited to the particular embodiments set forth herein. Rather, these embodiments are provided so that this disclosure will be thorough and complete, and will convey the scope of the present disclosure to those skilled in the art.

A shape, a size, a ratio, an angle, and a number disclosed in the drawings for describing embodiments of the present disclosure are merely exemplary, and thus, the present disclosure is not limited to the illustrated details.

Terms such as "comprise", "have", and "include" are used in the present specification to have an inclusive meaning, and additional parts, components, features or the like may be added unless expressly limited by terms such as "only". The terms of a singular form may include plural forms unless explicitly limited to the singular form.

In construing an element, the element is construed as including an error range although there may not be any explicit description thereof.

In describing a positional relationship, for example, when a positional relation between two parts is described as "on", "over", "under", and "next", one or more other parts may be disposed between the two parts unless expressly limiting terms such as "just" or "direct" are used.

In describing a time relationship, for example, when the temporal order is described as "after", "subsequent", "next", and "before", a case which is not continuous in order may be included unless expressly limiting terms such as "just" or "direct" are used.

It will be understood that, although the terms "first", "second", etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" includes all combinations of two or more of any of the first, second, and third items, as well as any single one of the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in a co-dependent relationship.

Hereinafter, exemplary embodiments of the present disclosure will be described in detail with reference to the accompanying drawings.

Figure 2:
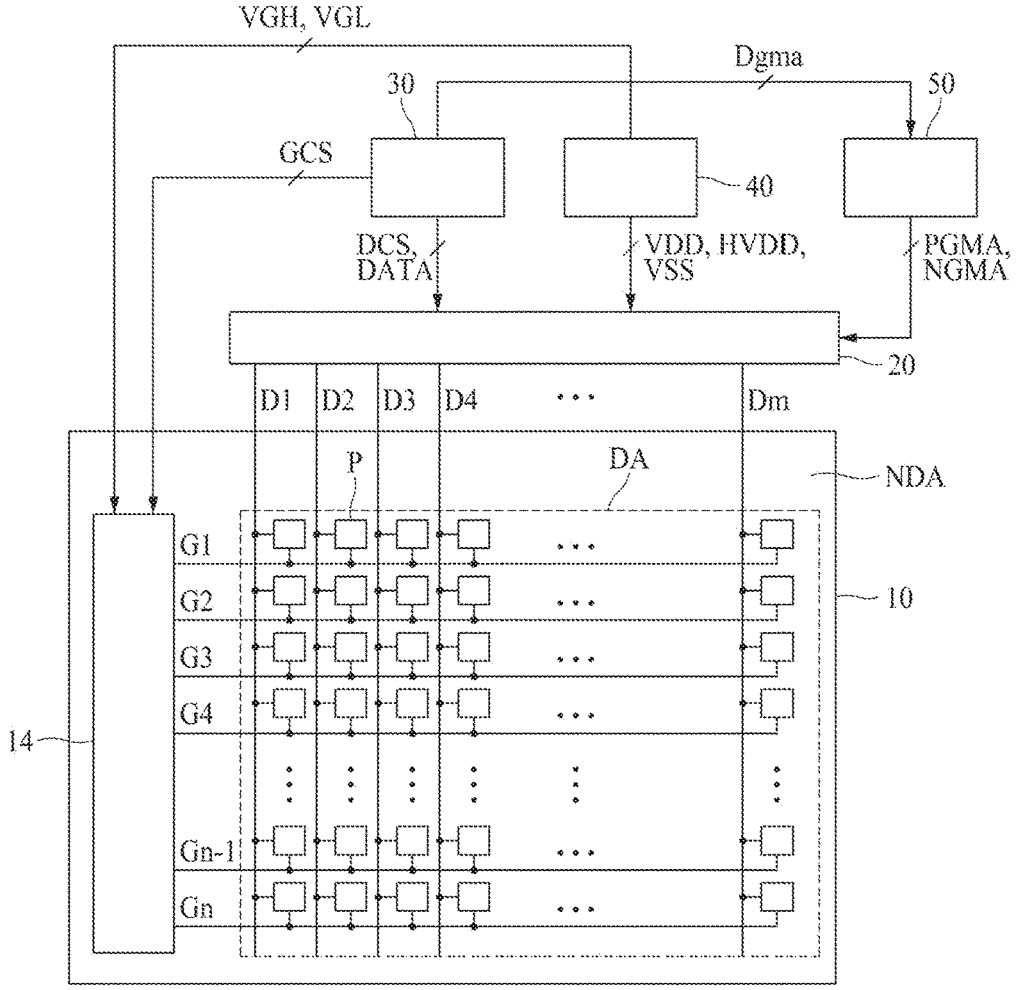
FIG. 2 is a block diagram illustrating a display device according to an embodiment of the present disclosure.
Figure 3:
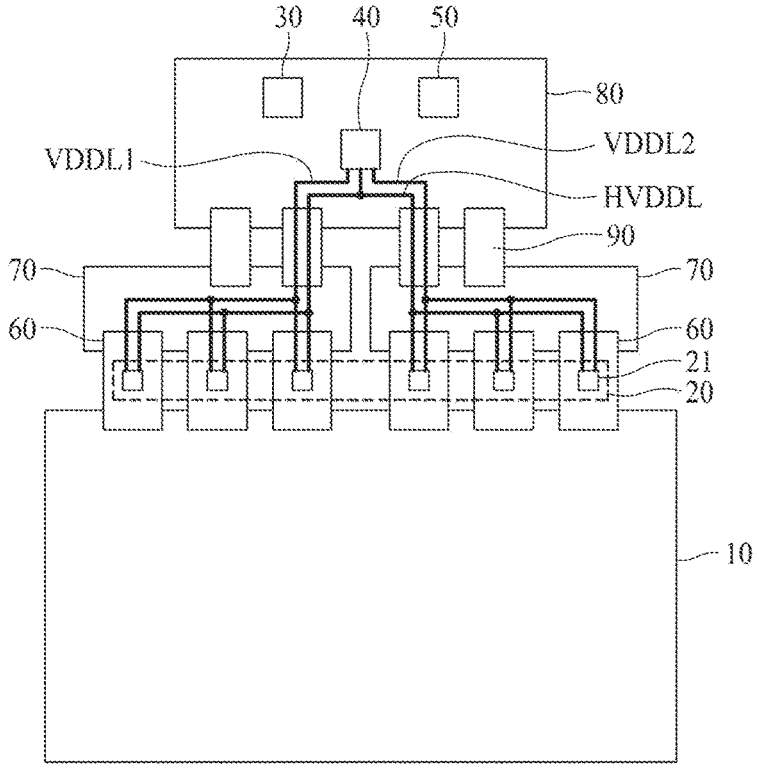
FIG. 3 is a diagram illustrating a lower substrate, source drive ICs, source flexible films, a source circuit board, a control circuit board, and a timing controller of a display device according to an embodiment of the present disclosure and a power supply unit according to an embodiment of the present disclosure.

FIG. 2 is a block diagram illustrating a display device according to an embodiment of the present disclosure. FIG. 3 is a diagram illustrating a lower substrate, source drive ICs, source flexible films, a source circuit board, a control circuit board, and a timing controller of a display device according to an embodiment of the present disclosure, and a power supply unit and a gamma reference voltage supply unit according to an embodiment of the present disclosure.

Examples of the display device according to an embodiment of the present disclosure may include all display devices which supply data voltages to pixels in a line scanning method of supplying gate signals to gate lines G1 to Gn. For example, the display device according to an embodiment of the present disclosure may be implemented as one of a liquid crystal display (LCD) device, an organic light emitting display device, a field emission display device, an electrophoresis display device, etc. In embodiments of the present disclosure, an example where the display device is implemented as an LCD device will be described, but the present disclosure is not limited thereto.

Referring to FIGS. 2 and 3, the display device according to an embodiment of the present disclosure may include a display panel 10, a gate driver 14, a data driver 20, a timing controller 30, a power supply unit 40, and a gamma reference voltage supply unit 50.

The display panel 10 may display an image by using a plurality of pixels. The display panel 10 may include a lower substrate, an upper substrate, and a liquid crystal layer between the lower substrate and the upper substrate. A plurality of data lines D and a plurality of gate lines G may be arranged on the lower substrate of the display panel 10. The data lines D may intersect the gate lines G.

Figure 4:
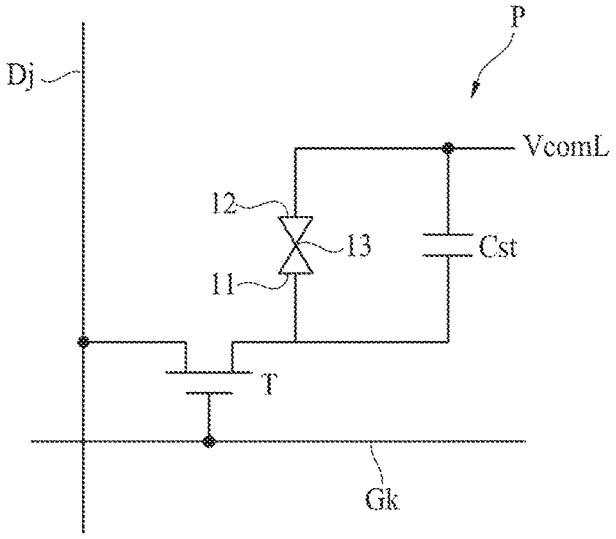
FIG. 4 is a circuit diagram illustrating an example of a pixel of FIG. 2.

The pixels P, as in FIG. 2, may be respectively provided in a plurality of areas defined by intersections of the data lines D and the gate lines G. Each of the pixels P may be connected to a data line D and a gate line G. The pixels P, as in FIG. 4, may each include a transistor T, a pixel electrode 11, a common electrode 12, a liquid crystal layer 13, and a storage capacitor Cst. The transistor T may be turned on by a gate signal of the gate line G and may supply a data voltage of the data line D to the pixel electrode 11. The common electrode 12 may be connected to a common line and may be supplied with a common voltage through the common line. Therefore, each of the pixels P may drive a liquid crystal of the liquid crystal layer 13 with an electric field generated from a potential difference between the data voltage supplied to the pixel electrode 11 and the common voltage supplied to the common electrode 12, thereby adjusting a transmittance of light incident from a backlight unit. As a result, the pixels P may display an image. Also, the storage capacitor Cst may be provided between the pixel electrode 11 and the common electrode 12 and may maintain a constant potential difference between the pixel electrode 11 and the common electrode 12.

In a vertical electric field mode such as a twisted nematic (TN) mode or a vertical alignment (VA) mode, the common electrode 12 is provided on the upper substrate. In a lateral electric field mode such as an in-plane switching (IPS) mode or a fringe field switching (FFS) mode, the common electrode 12 is provided on the lower substrate. A liquid crystal mode of the display panel 10 may be implemented as an arbitrary liquid crystal mode as well as the TN mode, the VA mode, the IPS mode, and the FFS mode.

A black matrix, color filters, and the like may be provided on the upper substrate of the display panel 10. Each of the color filters may be provided in an opening which is not covered by the black matrix. In a case where the display panel 10 is provided in a color filter on TFT (COT) structure, the black matrix and the color filters may be provided on the lower substrate of the display panel 10.

A polarizer may be attached on each of the lower substrate and the upper substrate of the display panel 10, and an alignment layer for adjusting a pre-tilt angle of the liquid crystal may be provided on each of the lower substrate and the upper substrate. A color spacer for maintaining a cell gap of the liquid crystal layer may be provided between the lower substrate and the upper substrate of the display panel 10.

The display panel 10 may representatively use a transmissive liquid crystal display panel which modulates light from the backlight unit. The backlight unit may include light sources that emits light with a driving current supplied from a backlight driver, a light guide plate (or a diffusive plate), and a plurality of optical sheets. The backlight unit may be implemented as a direct type or edge type backlight unit. The light sources of the backlight unit may include one or two or more of a hot cathode fluorescent lamp (HCFL), a cold cathode fluorescent lamp (CCFL), an external electrode fluorescent lamp (EEFL), a light emitting diode (LED), and an organic light emitting diode (OLED).

The backlight driver may generate the driving current for turning on the light sources of the backlight unit. The backlight driver may generate the driving current supplied to the light sources according to control by the backlight controller. The backlight controller may transfer backlight control data, including a duty ratio control value of a pulse width modulation (PWM) signal, to the backlight driver in a serial peripheral interface (SPI) data format according to a global/local diming signal input from a host system or the timing controller 30.

The gate driver 14 may receive a gate control signal GCS from the timing controller 30 and may receive a gate high voltage VGH and a gate low voltage VGL from the power supply unit 40. The gate high voltage VGH may be a voltage for turning on transistors of the pixels P of the display panel 10 and may be set as a voltage for turning off the transistors of the pixels P of the display panel 10. The gate driver 14 may generate gate signals which swing from the gate low voltage VGL to the gate high voltage VGH and may supply the gate signals to the gate lines G1 to Gn according to the gate control signal GCS.

The gate driver 14 may be disposed in a non-display area NDA in a gate driver in panel (GIP) type. In FIG. 1, an example where the gate driver 14 is disposed in the non-display area NDA outside one side of a display area DA is illustrated, but the present embodiment is not limited thereto. In other embodiments, the gate driver 14 may be disposed in the non-display area NDA outside both sides of the display area DA.

Alternatively, the gate driver 14 may include a plurality of gate drive ICs, and the gate driver ICs may be mounted on gate flexible films. Each of the gate flexible films may be a tape carrier package or a chip-on film. Each of the gate flexible films may be attached on the non-display area NDA of the display panel 10 in a tape automated bonding (TAB) type by using an anisotropic conductive film, and thus, the gate drive ICs may be connected to the gate lines G1 to Gn.

The data driver 20 may receive digital video data DATA and a data control signal DCS from the timing controller 30. The data driver 20 may receive first and second VDD voltages VDD1 and VDD2, an HVDD voltage HVDD, and a VSS voltage VSS from the power supply unit 40. The data driver 20 may receive gamma reference voltages PGMA and NGMA from the gamma reference voltage supply unit 50. The first VDD voltage VDD1 may be referred to herein as a "first voltage," the second VDD voltage VDD2 may be referred to herein as a "second voltage," and the HVDD voltage HVDD may be referred to herein as a "third voltage."

The data driver 20 may include at least one source drive IC 21. The source drive IC 21 may divide the gamma reference voltages PGMA and NGMA to generate gamma grayscale voltages. The source driver IC 21 may convert the digital video data DATA into analog data voltages according to the data control signal DCS, based on the gamma grayscale voltages. The source drive IC 21 may supply the analog data voltages to the data lines D1 to Dm. A detailed description of the source drive IC 21 will be described below with reference to FIG. 5.

Each of the source driver ICs 21 may be manufactured as a driving chip. Each of the source drive ICs 21 may be mounted on a source flexible film 60. The source flexible film 60 may be provided in plurality, and each of the source flexible films 60 may be implemented as a tape carrier package or a chip-on film and may be bent or curved. Each of the source flexible films 60 may be attached on the non-display area NDA of the display panel 10 in a TAB type by using an anisotropic conductive film, and thus, the source flexible films 60 may be connected to the data lines D1 to Dm.

Alternatively, the source drive ICs 21 may be directly attached on the lower substrate in a chip-on glass (COG) type or a chip-on plastic (COP) type and may be connected to the data lines D1 to Dm.

The source flexible films 60 may be attached on a source circuit board 70. The source circuit board 70 may be a flexible printed circuit board (FPCB) capable of being bent or curved. The source circuit board 70 may be provided as one or in plurality.

The timing controller 30 may receive the video data DATA and timing signals TS from an external system board (not shown). The timing signals TS may include a vertical sync signal, a horizontal sync signal, a data enable signal, and a dot clock.

The timing controller 30 may generate the gate control signal GCS for controlling an operation timing of the gate driver 14 and the data control signal DCS for controlling an operation timing of the data driver 20, based on the timing signals TS and driving timing information which is stored in a memory such as electrically erasable programmable read-only memory (EEPROM). The timing controller 30 may supply the gate control signal GCS to the gate driver 14. The timing controller 30 may supply the video data DATA and the data control signal DCS to the data driver 20.

The power supply unit 40 may generate voltages necessary for driving of the gate driver 14, the data driver 20, and the timing controller 30 and may respectively supply the voltages thereto. The power supply unit 40 may supply the gate high voltage VGH and the gate low voltage VGL to the gate driver 14. The gate high voltage VGH may be a voltage for turning on the transistors of the pixels P of the display panel 10, and the gate low voltage VGL may be a voltage for turning off the transistors of the pixels P of the display panel 10.

The power supply unit 40 may supply the first and second VDD voltages VDD1 and VDD2, the HVDD voltage HVDD, and the VSS voltage VSS to the data driver 20. The first and second VDD voltages VDD1 and VDD2 may each be a voltage having a level higher than that of the HVDD voltage HVDD. The HVDD voltage HVDD may each be a voltage having a level higher than that of the VSS voltage VSS.

Recently, as consumer demand increases, 60 or more inches large screen display devices are being released. In large screen display devices, consumption current considerably increases due to the VDD voltage which is a driving voltage of the source drive IC 21. Therefore, in the large screen display devices, the power supply unit 40 may include a plurality of VDD voltage generators, for example, a first VDD voltage generator and a second VDD voltage generator. In this case, as in FIG. 3, the first VDD voltage generator may supply the first VDD voltage to some of the source drive ICs 21 through a first VDD voltage line VDDL1, and the second VDD voltage generator may supply the second VDD voltage to the other source drive ICs 21 through a second VDD voltage line VDDL2, thereby stably supplying the VDD voltage to the source drive ICs 21.

The power supply unit 40, as in FIG. 3, may supply the HVDD voltage HVDD to all of the source drive ICs 21 through an HVDD voltage line HVDDL. The power supply unit 40 may supply a driving voltage to the timing controller 30 and the gamma reference voltage supply unit 50. A detailed description of the power supply unit 40 will be described below with reference to FIG. 7.

The gamma reference voltage supply unit 50 may receive gamma reference voltage data Dgma from the timing controller 30 to generate the gamma reference voltages PGMA and NGMA based on the gamma reference voltage data Dgma. The gamma reference voltages may include positive gamma reference voltages PGMA and negative gamma reference voltages NGMA. In a case where the display device is an LCD device, the positive gamma reference voltages PGMA may each denote a high-level voltage with respect to the common voltage, and the negative gamma reference voltages NGMA may each be a low-level voltage with respect to the common voltage.

The timing controller 30, the power supply unit 40, and the gamma voltage supply unit 50 may be mounted on a control circuit board 80 as in FIG. 3. The control circuit board 80 may be connected to the source circuit board 70 through a flexible circuit board 90 such as a flexible flat cable (FFC) or a flexible printed circuit (FPC).

Figure 5:
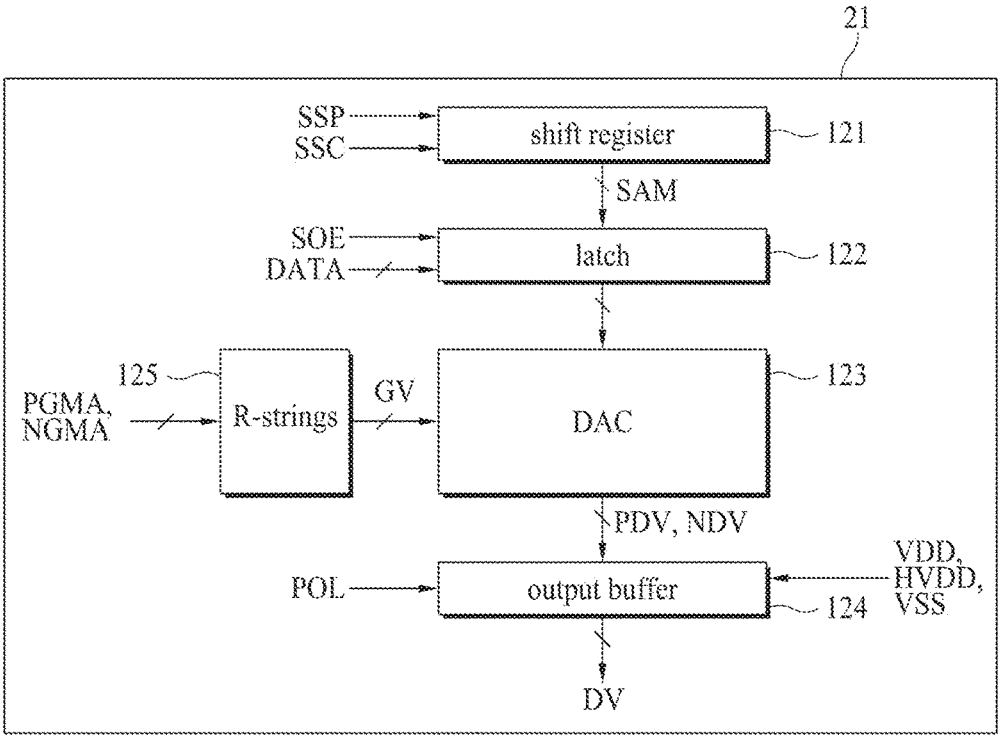
FIG. 5 is a block diagram illustrating in detail a source drive IC of FIG. 3.

FIG. 5 is a block diagram illustrating in detail the source drive IC 21 of FIG. 3. Referring to FIG. 5, the source drive IC 21 may include a shift register 121, a latch 122, a digital-analog converter (DAC) 123, an output buffer 124, and a voltage dividing circuit 125.

The source drive IC 21 may receive the data control signal DCS from the timing controller 30, receive first to third driving voltages HVDD, VDD, and VSS from the power supply unit 40, and receive the positive gamma reference voltages PGMA and the negative gamma reference voltages NGMA from the gamma reference voltage supply unit 50.

The data control signal DCS may include a source start pulse SSP, a source sampling clock SSC, a source output enable signal SOE, a polarity control signal POL, etc. The source start pulse SSP may control a data sampling start point of the source driver IC 21. The source sampling clock SSC may be a clock signal for controlling a data sampling operation in the source drive IC 21, based on a rising edge or a falling edge. The source output enable signal SOE may control an output of the source drive IC 21. The polarity control signal POL may control polarities of data voltages.

The shift register 121 may output a sampling signal SAM in response to the source start pulse SSP and the source sampling clock SSC. The latch 123 may sequentially sample the video data DATA in response to the sampling signal SAM output from the shift register 121 and may simultaneously output the sampled video data DATA for one horizontal line according to the source output enable signal SOE. The latch 123 may be provided as two or more, but for convenience of description, only one latch 123 is illustrated and described.

The DAC 123 may receive gamma grayscale voltages GV from the voltage dividing circuit 125. The DAC 123 may convert the video data DATA for one horizontal line into positive and negative data voltages PDV and NDV by using the gamma grayscale voltages GV. That is, the DAC 123 may convert the video data DATA, which are digital video data, into analog data voltages.

The output buffer 124 may include a plurality of positive output buffers for outputting the positive data voltages PDV without a voltage drop and a plurality of negative output buffers for outputting the negative data voltages NDV without the voltage drop. The positive output buffers may output the positive data voltages PDV between the first VDD voltage VDD1 or the second VDD voltage VDD2 and the HVDD voltage HVDD. The negative output buffers may output the negative data voltages NDV between the VSS voltage VSS and the HVDD voltage HVDD. Also, the output buffer 124 may select one data voltage from among the positive data voltage PDV output from the positive output buffer and the negative data voltage NDV output from the negative output buffer and may output the selected data voltage DV to a corresponding data line of the data lines D1 to Dm. A detailed description of the output buffer 124 will be described below with reference to FIG. 6.

The voltage dividing circuit 125 may receive the positive gamma reference voltages PGMA and the negative gamma reference voltages NGMA. The voltage dividing circuit 125 may include a plurality of resistor strings R-strings. The voltage dividing circuit 125 may divide the positive gamma reference voltages PGMA and the negative gamma reference voltages NGMA by using the resistor strings R-strings to generate the gamma grayscale voltages GV. The gamma grayscale voltages GV may include positive gamma grayscale voltages and negative gamma grayscale voltages. The positive data voltages PDA may be generated from the positive gamma grayscale voltages and the negative data voltages NDA may be generated from the negative gamma grayscale voltages.

Figure 6:
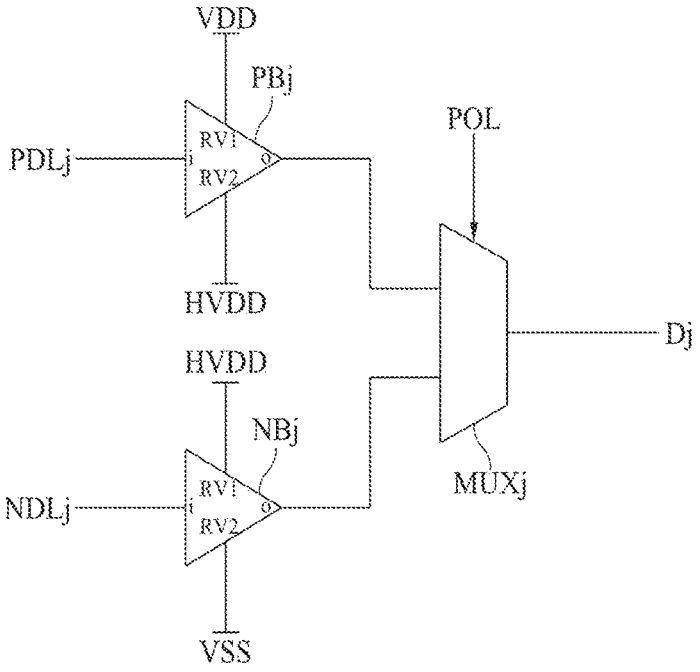
FIG. 6 is a circuit diagram illustrating in detail an output buffer of FIG. 5.

FIG. 6 is a circuit diagram illustrating in detail the output buffer of FIG. 5. In FIG. 6, for convenience of description, only a jth positive output buffer PBj, a jth negative output buffer NBj, and a jth multiplexer MUXj for outputting a data voltage to a jth data line Dj are illustrated.

Referring to FIG. 6, an input terminal (i) of the jth positive output buffer PBj may be connected to a jth positive data voltage line PDLj, and an output terminal (o) may be connected to the jth multiplexer MUXj. The jth positive data voltage line PDLj may be a line which is connected to the DAC 123 and through which a jth positive data voltage output from the DAC 123 is output. The jth positive output buffer PBj may output the jth positive data voltage to the jth multiplexer MUXj.

Moreover, the first VDD voltage VDD1 or the second VDD voltage VDD2 may be input to a first reference voltage terminal (RV1) of the jth positive output buffer PBj, and the HVDD voltage HVDD may be input to a second reference voltage terminal (RV2). Therefore, the jth positive output buffer PBj may output a voltage between a first driving voltage HVDD and a second driving voltage VDD.

An input terminal (j) of the jth negative output buffer NBj may be connected to a jth negative data voltage line NDLj, and an output terminal (o) may be connected to the jth multiplexer MUXj. The jth negative data voltage line NDLj may be a line which is connected to the DAC 123 and through which a jth negative data voltage output from the DAC 123 is output. The jth negative output buffer NBj may output the jth negative data voltage to the jth multiplexer MUXj.

Moreover, the HVDD voltage HVDD may be input to a first reference voltage terminal (RV1) of the jth negative output buffer NBj, and the VSS voltage VSS may be input to a second reference voltage terminal (RV2). Therefore, the jth negative output buffer NBj may output a voltage between the HVDD voltage HVDD and the VSS voltage VSS.

The HVDD voltage HVDD may be input to the second reference voltage terminal (RV2) of the jth positive output buffer PBj, and thus, may be input as a minimum voltage capable of being output by the jth positive output buffer PBj. Also, the HVDD voltage HVDD may be input to the first reference voltage terminal (RV1) of the jth negative output buffer NBj, and thus, may be input as a maximum voltage capable of being output by the jth negative output buffer NBj. Therefore, the HVDD voltage HVDD should be designed as a voltage for satisfying both a minimum value of the positive data voltages and a maximum value of the negative data voltages. That is, the HVDD voltage HVDD may be designed as a voltage between the minimum value of the positive data voltages and the maximum value of the negative data voltages. For example, the VDD voltage may be 20V, the HVDD voltage may be 10V, the VSS voltage may be 0V. Also, the HVDD voltage may be substantially same as the common voltage.

The jth multiplexer MUXj may receive the jth positive data voltage output from the jth positive output buffer PBj and the jth negative data voltage output from the jth negative output buffer NBj. Also, the jth multiplexer MUXj may receive the polarity control signal POL. The jth multiplexer MUXj may select one data voltage from among the jth positive data voltage and the jth negative data voltage according to the polarity control signal POL and may output the selected one data voltage to the jth data line Dj. For example, when the polarity control signal POL having a first logic level voltage is input, the jth multiplexer MUXj may select the jth positive data voltage to output the jth positive data voltage to the jth data line Dj, and when the polarity control signal POL having a second logic level voltage is input, the jth multiplexer MUXj may select the jth negative data voltage to output the jth negative data voltage to the jth data line Dj.

As described above, the output buffer 124 of each of the source drive ICs 21 may be supplied with the first or second VDD voltage VDD1 or VDD2, the HVDD voltage HVDD, and the VSS voltage VSS from the power supply unit 40. Particularly, the demand for large screen display devices is increasing, and in the large screen display devices, consumption current considerably increases due to the VDD voltage which is the driving voltage of the source drive IC 21. Therefore, the power supply unit 40 according to an embodiment of the present disclosure may include the plurality of VDD voltage generators, for example, the first VDD voltage generator and the second VDD voltage generator. In this case, the first VDD voltage generator may supply the first VDD voltage VDD1 to some of the source drive ICs 21, and the second VDD voltage generator may supply the second VDD voltage VDD2 to the other source drive ICs 21, thereby stably supplying the VDD voltage to all of the source drive ICs 21. Hereinafter, the power supply unit 70 according to an embodiment of the present disclosure will be described in detail with reference to FIG. 7.

Figure 7:
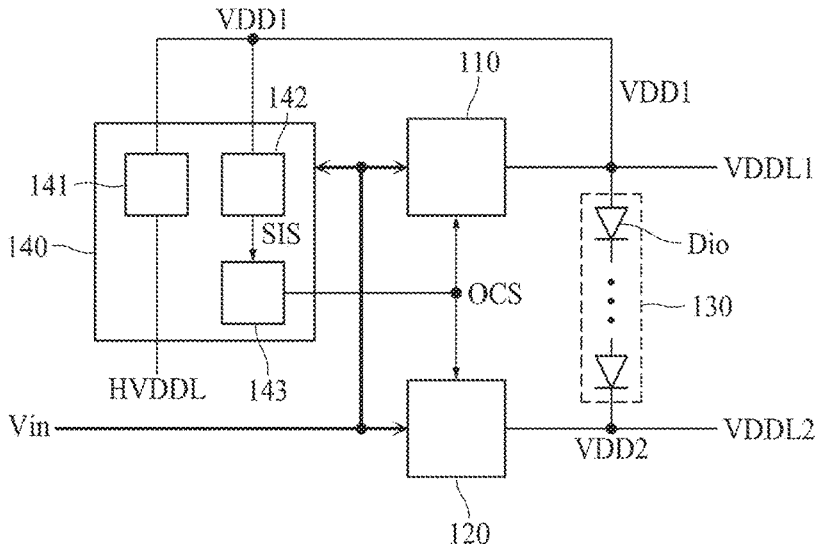
FIG. 7 is a block diagram illustrating in detail an example of a power supply unit of FIG. 2.

FIG. 7 is a block diagram illustrating in detail an example of the power supply unit of FIG. 2. Referring to FIG. 7, a power supply unit 40 may include a first VDD voltage generator 110, a second VDD voltage generator 120, a diode circuit 130, and a power manager 140.

The first VDD voltage generator 110 may be supplied with power Vin from the outside, and when the power Vin is input, the first VDD voltage generator 110 may generate a first VDD voltage VDD1 and may output the first VDD voltage VDD1 to a first VDD voltage line VDDL1. The first VDD voltage VDD1 may be supplied to some of the source drive ICs 21 through the control circuit board 80, the flexible circuit board 90, the source circuit board 70, and the source flexible films 60. The first VDD voltage generator 110 may be implemented as a boost IC.

The second VDD voltage generator 120 may be supplied with the power Vin from the outside, and when the power Vin is input, the second VDD voltage generator 120 may generate a second VDD voltage VDD2 and may output the second VDD voltage VDD2 to a second VDD voltage line VDDL2. The second VDD voltage VDD2 may be supplied to the other source drive ICs 21 through the control circuit board 80, the flexible circuit board 90, the source circuit board 70, and the source flexible films 60. The second VDD voltage generator 120 may be implemented as a boost IC.

The diode circuit 130 may include one or more diodes Dio. The one or more diodes Dio may each be configured with a general diode, a Schottky barrier diode, or a combination thereof. Hereinafter, for convenience of description, an example where the diode circuit 130 includes p (where p is an integer, here equal to or more than two) number of diodes Dio will be described. However, as said above, the diode circuit 130 may also include only one diode, i.e., p being equal to one.

The p diodes Dio may be serially connected to each other as in FIG. 7. Anode electrodes of the p diodes Dio may be electrically connected to the first VDD voltage line VDDL1, and cathode electrodes may be electrically connected to the second VDD voltage line VDDL2. More particularly, in a case where a plurality of diodes Dio are connected to each other in series, an anode electrode of a first diode is electrically connected to the first VDD voltage line VDDL1, and a cathode electrode of a last diode of the series connected diodes (e.g., the p-th diode) is connected to the second VDD voltage line VDDL2. Therefore, in a case where a threshold voltage of each of the p diodes Dio is "Vth", if a difference between the first VDD voltage VDD1 of the first VDD voltage line VDDL1 and the second VDD voltage VDD2 of the second VDD voltage line VDDL2 is greater than "p×Vth", a current may flow from the first VDD voltage line VDDL1 to the second VDD voltage line VDDL2.

The power manager 140 may include an HVDD voltage generator 141, a short circuit detector 142, and a voltage output controller 143.

The HVDD voltage generator 141 may be connected to the first VDD voltage line VDDL1 and may be supplied with the first VDD voltage VDD1 of the first VDD voltage generator 110. The HVDD voltage generator 141 may generate an HVDD voltage HVDD using the first VDD voltage VDD1 and may output the HVDD voltage HVDD to an HVDD voltage line HVDDL. The HVDD voltage HVDD may be supplied to each of the source drive ICs 21 through the control circuit board 80, the flexible circuit board 90, the source circuit board 70, and the source flexible films 60. The HVDD voltage generator 141 may be implemented with a buck converter.

The short circuit detector 142 may be connected to the first VDD voltage line VDDL1 and may be supplied with the first VDD voltage VDD1 of the first VDD voltage generator 110. The short circuit detector 142 may monitor whether the first VDD voltage VDD1 is lowered to a threshold voltage level or less. When the first VDD voltage VDD1 is lowered to the threshold voltage level or less, the short circuit detector 142 may determine the first VDD voltage VDD1 or, indirectly (explained below), the second VDD voltage VDD2 as being short-circuited to a ground. When the first VDD voltage VDD1 of the first VDD voltage generator 110 is lowered to a threshold voltage level or less, the short circuit detector 142 may output a short circuit detection signal SIS having a first logic level voltage, and if not, the short circuit detector 142 may output a short circuit detection signal SIS having a second logic level voltage. The threshold voltage level may be a level which is substantially the same as that of a ground voltage, or may be a voltage level between the ground voltage and the first VDD voltage VDD1.

When a short circuit of the first VDD voltage VDD1 or the second VDD voltage VDD2 is detected by the short circuit detector 142, the voltage output controller 143 may control the first and second VDD voltage generators 110 and 120 not to output the first VDD voltage VDD1 or the second VDD voltage VDD2. Also, when the short circuit of the first VDD voltage VDD1 or the second VDD voltage VDD2 is detected by the short circuit detector 142, the voltage output controller 143 may control the voltage generators of the power manager 140 as well as the first and second VDD voltage generators 110 and 120 so as not to output voltages.

For example, when the voltage output controller 143 receives the short circuit detection signal SIS having the first logic level voltage from the short circuit detector 142, the voltage output controller 143 may output a voltage output control signal OCS having the second logic level voltage. Also, when the voltage output controller 143 receives the short circuit detection signal SIS having the second logic level voltage from the short circuit detector 142, the voltage output controller 143 may output a voltage output control signal OCS having the first logic level voltage. In this case, when the first and second VDD voltage generators 110 and 120 receive the voltage output control signal OCS having the second logic level voltage, the first and second VDD voltage generators 110 and 120 may not output the first and second VDD voltages VDD1 and VDD2, and when the first and second VDD voltage generators 110 and 120 receive the voltage output control signal OCS having the first logic level voltage, the first and second VDD voltage generators 110 and 120 may output the first and second VDD voltages VDD1 and VDD2.

In FIG. 7, for convenience of description, an example where the power manager 140 includes the HVDD voltage generator 141, the short circuit detector 142, and the voltage output controller 143 is illustrated. However, the power manager 140 may further include a gate high voltage generator which generates the gate high voltage VGH, a gate low voltage generator which generates the gate low voltage VGL, and a VCC voltage generator which generates a VCC voltage, in addition to the HVDD voltage generator 141, the short circuit detector 142, and the voltage output controller 143. The power manager 140 may be implemented with a power management IC.

Moreover, in FIG. 7, the short circuit detector 142 and the voltage output controller 143 are each illustrated as a separate block, but the short circuit detector 142 may be included in the voltage output controller 143.

Moreover, in FIG. 7, the first and second VDD voltage generators 110 and 120 are each illustrated as being designed as a separate IC without being built into the power manager 140, but are not limited thereto. In other embodiments, one of the first and second VDD voltage generators 110 and 120 may be built into the power manager 140.

Figure 8A:
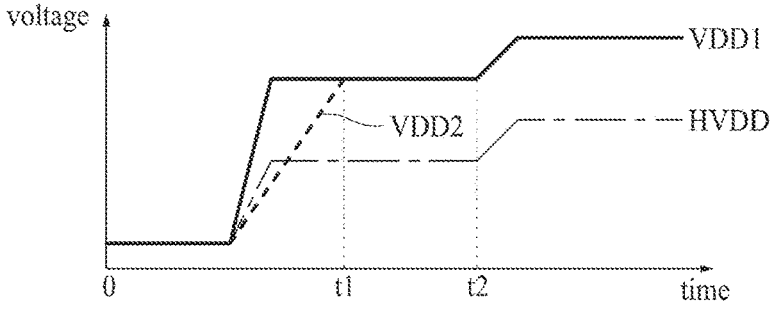
FIGS. 8A and 8B are waveform diagrams showing an increase order of a first VDD voltage, a second VDD voltage, and an HVDD voltage of a power supply unit in the related art and in an embodiment of the present disclosure, respectively.
Figure 8B:
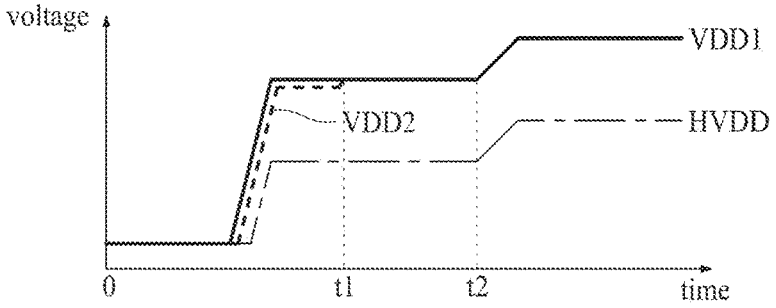

FIGS. 8A and 8B are waveform diagrams showing an increase order of a first VDD voltage, a second VDD voltage, and an HVDD voltage of a power supply unit in the related art and an embodiment of the present disclosure, respectively.

In the related art, the diode circuit 130 connected between the first VDD voltage line VDDL1 and the second VDD voltage line VDDL2 is not provided. Therefore, in the related art, as shown in FIG. 8A, when power is input, due to a difference between a VDD voltage increase time of the first VDD voltage generator 110 and a VDD voltage increase time of the second VDD voltage generator 120, the VDD voltage can be supplied later than the HVDD voltage to the source drive IC 21. For example, as in FIG. 7, in a case where the HVDD voltage HVDD is generated from the first VDD voltage VDD1, if an increase time of the second VDD voltage VDD2 is slower than an increase time of the first VDD voltage VDD1, as in FIG. 8A, the first VDD voltage VDD1 increases, the HVDD voltage HVDD increases subsequently, and then, the second VDD voltage VDD2 increases. In this case, some of the source drive ICs 21 are supplied with the HVDD voltage HVDD, and then, are supplied with the second VDD voltage VDD2. That is, a supply reversal between the VDD voltage and the HVDD voltage can occur in some of the source drive ICs 21, and the source drive ICs 21 can be damaged due to the supply reversal between the VDD voltage and the HVDD voltage.

On the other hand, in an embodiment of the present disclosure, the diode circuit 130 connected between the first VDD voltage line VDDL1 and the second VDD voltage line VDDL2 is provided. Therefore, in an embodiment of the present disclosure, as shown in FIG. 8B, when power is input, although a difference occurs between a VDD voltage increase time of the first VDD voltage generator 110 and a VDD voltage increase time of the second VDD voltage generator 120, the second VDD voltage line VDDL2 is charged with "VDD1−(p×Vth)" by the diode circuit 130. As a result, even when an increase time 0 to t1 of the second VDD voltage VDD2 is slower than an increase time of the first VDD voltage VDD1, as in FIG. 8B, the first VDD voltage VDD1 increases, the second VDD voltage VDD2 increases subsequently, and then, the HVDD voltage HVDD increases. In this case, a supply reversal between the VDD voltage and the HVDD voltage supplied to the source drive ICs 21 does not occur. Accordingly, the source drive ICs 21 are prevented from being damaged by the supply reversal between the VDD voltage and the HVDD voltage.

Meanwhile, the first VDD voltage VDD1, the second VDD voltage VDD2, and the HVDD voltage HVDD may reach the maximum voltage of each of them after second time t2 in order to limit inrush current which can deteriorate components at a start-up.

Figure 9A:
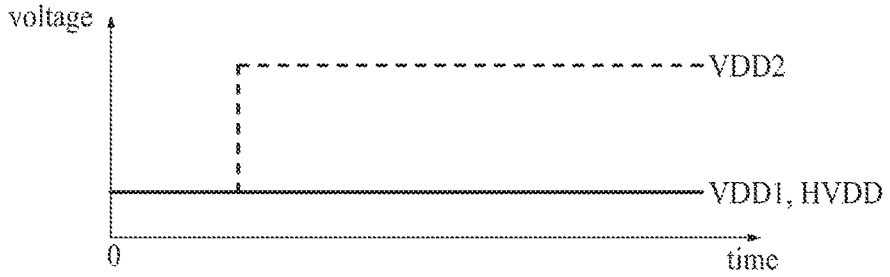
FIGS. 9A and 9B are waveform diagrams showing a first VDD voltage, a second VDD voltage, and an HVDD voltage when a first VDD voltage line is short-circuit to a ground, in the related art and in an embodiment of the present disclosure, respectively.
Figure 9B:
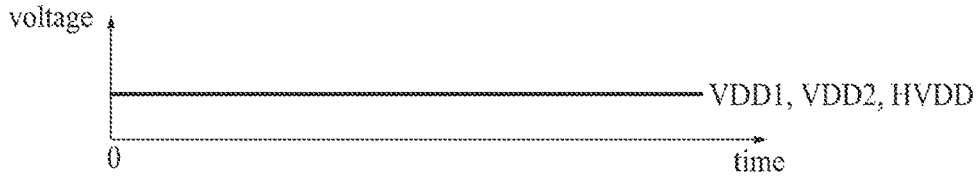

FIGS. 9A and 9B are waveform diagrams showing a first VDD voltage, a second VDD voltage, and an HVDD voltage when a first VDD voltage line is short-circuit to a ground, in the related art and an embodiment of the present disclosure, respectively.

In the related art, even when the first VDD voltage line VDDL1 is short-circuited to the ground, control is not performed in order for the first and second VDD voltage generators 110 and 120 not to output the first and second VDD voltages VDD1 and VDD2. Therefore, in the related art, as shown in FIG. 9A, even when the first VDD voltage line VDDL1 is short-circuited to the ground, the second VDD voltage generator 120 outputs the second VDD voltage VDD2 as-is, and thus, the second VDD voltage line VDDL2 holds the second VDD voltage VDD2 as-is. Accordingly, in the related art, when the first VDD voltage line VDDL1 is short-circuited to the ground, the first and second VDD voltages VDD1 and VDD2 are supplied to the source drive ICs 21 at different levels, and thus, the display panel 10 displays an abnormal image.

On the other hand, in an embodiment of the present disclosure, when the first VDD voltage line VDDL1 is short-circuited to the ground, as shown in FIG. 9B, control is performed in order for the first and second VDD voltage generators 110 and 120 not to output the first and second VDD voltages VDD1 and VDD2. Therefore, in an embodiment of the present disclosure, when the first VDD voltage line VDDL1 is short-circuited to the ground, the second VDD voltage generator 120 does not output the second VDD voltage VDD2. That is, in an embodiment of the present disclosure, when the first VDD voltage line VDDL1 is short-circuited to the ground, the power manager 140 senses the short circuit, and thus, performs control in order for the first and second VDD voltages VDD1 and VDD2 not to be supplied to the source drive ICs 21. Accordingly, in an embodiment of the present disclosure, when the first VDD voltage line VDDL1 is short-circuited to the ground, the first and second VDD voltages VDD1 and VDD2 are supplied at the same ground level, thereby preventing the display panel 10 from displaying an abnormal image.

Figure 10A:
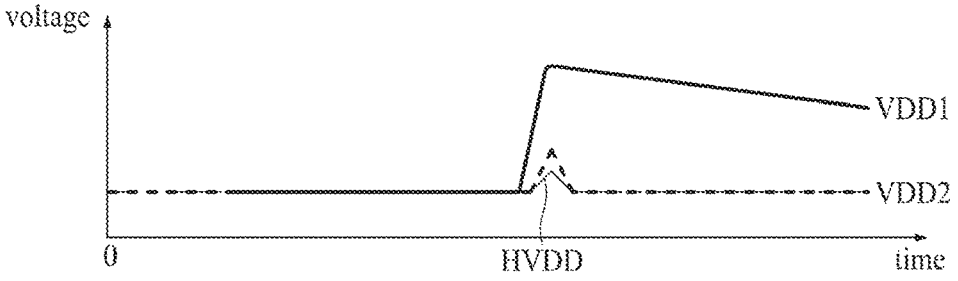
FIGS. 10A and 10B are waveform diagrams showing a first VDD voltage, a second VDD voltage, and an HVDD voltage when a second VDD voltage line is short-circuit to a ground, in the related art and in an embodiment of the present disclosure, respectively.
Figure 10B:
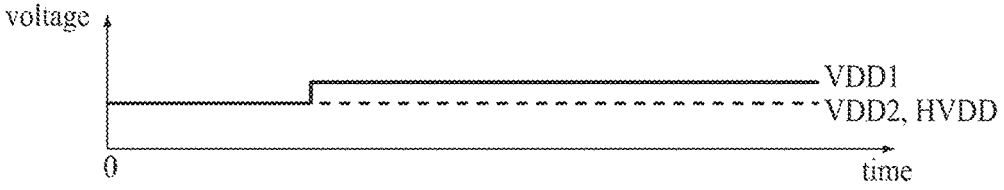

FIGS. 10A and 10B are waveform diagrams showing a first VDD voltage, a second VDD voltage, and an HVDD voltage when a second VDD voltage line is short-circuit to a ground, in the related art and an embodiment of the present disclosure, respectively.

In the related art, the diode circuit 130 connected between the first VDD voltage line VDDL1 and the second VDD voltage line VDDL2 is not provided. Also, in the related art, even when the second VDD voltage line VDDL2 is short-circuited to the ground, as shown in FIG. 10A, control is not performed in order for the first and second VDD voltage generators 110 and 120 not to output the first and second VDD voltages VDD1 and VDD2. Therefore, in the related art, even when the second VDD voltage line VDDL2 is short-circuited to the ground, the first VDD voltage generator 110 outputs the first VDD voltage VDD1 as-is. Accordingly, in the related art, when the second VDD voltage line VDDL2 is short-circuited to the ground, the first and second VDD voltages VDD1 and VDD2 are supplied to the source drive ICs 21 at different levels, and thus, the display panel 10 displays an abnormal image.

On the other hand, in an embodiment of the present disclosure, the diode circuit 130 connected between the first VDD voltage line VDDL1 and the second VDD voltage line VDDL2 is provided. Also, in an embodiment of the present disclosure, when the second VDD voltage line VDDL2 is short-circuited to the ground, as shown in FIG. 10B, control is performed in order for the first and second VDD voltage generators 110 and 120 not to output the first and second VDD voltages VDD1 and VDD2. In detail, in an embodiment of the present disclosure, the first VDD voltage VDD1 of the first VDD voltage line VDDL1 is discharged to the ground through the second VDD voltage line VDDL2 via the diode circuit 130. Also, in an embodiment of the present disclosure, since the first VDD voltage VDD1 of the first VDD voltage line VDDL1 is lowered to the threshold voltage level or less, the power manager 140 senses the short circuit, and thus, control is performed in order for the first and second VDD voltages VDD1 and VDD2 not to be supplied to the source drive ICs 21. Due to a plurality of diodes Dio included in the diode circuit 130, a difference "p×Vth" occurs between the first VDD voltage VDD1 and the second VDD voltage VDD2. As a result, in an embodiment of the present disclosure, when the second VDD voltage line VDDL2 is short-circuited to the ground, the second VDD voltage VDD2 is supplied at the ground voltage level, and the first VDD voltage VDD1 is supplied at a level similar to the ground voltage, thereby preventing the display panel 10 from displaying an abnormal screen.

Meanwhile, there may be a current for charging capacitors of the first VDD voltage line regardless of the second VDD voltage line VDDL2 short-circuited to the ground, thus the first VDD voltage VDD1 may be slightly increased due to the current. The increased voltage of the first VDD voltage line may be discharged into the second VDD voltage line via the diode circuit 130 since the second VDD voltage line VDDL2 is short-circuited to the ground. When the increased voltage of first VDD voltage line is higher than "p×Vth" of the diode circuit 103, the first VDD voltage VDD1 may be higher as much as "p×Vth" than the second VDD voltage VDD2 and HVDD voltage HVDD in FIG. 10B.

As described above, according to the embodiments of the present disclosure, the power supply unit may include the diode circuit connected between the first and second VDD voltage lines. Therefore, in the embodiments of the present disclosure, even when an increase time of the second VDD voltage is slower than an increase time of the first VDD voltage, the second VDD voltage may increase after the first VDD voltage increases, and then, the HVDD voltage may increase. Accordingly, in the embodiments of the present disclosure, since a supply reversal between the VDD voltage and the HVDD voltage does not occur, the source driver IC is prevented from being damaged by the supply reversal between the VDD voltage and the HVDD voltage.

Moreover, according to the embodiments of the present disclosure, when the first VDD voltage line is short-circuited to the ground, the first and second VDD voltage generators may be controlled not to output the second VDD voltage. Therefore, in the embodiments of the present disclosure, when the first VDD voltage line is short-circuited to the ground, the first and second VDD voltages may be controlled so as not to be supplied to the source drive ICs. Accordingly, in the embodiments of the present disclosure, when the first VDD voltage line is short-circuited to the ground, the first and second VDD voltages may be supplied at the same ground level, thereby preventing the display panel from displaying an abnormal screen.

Furthermore, according to the embodiments of the present disclosure, the power supply unit may include the diode circuit connected between the first VDD voltage line and the second VDD voltage line, and when the second VDD voltage line is short-circuited to the ground, the first and second VDD voltage generators may be controlled not to output the first and second VDD voltages. In detail, in the embodiments of the present disclosure, when the second VDD voltage line is short-circuited to the ground, the first VDD voltage of the first VDD voltage line may be discharged to the ground through the second VDD voltage line via the diode circuit. In this case, the first VDD voltage of the first VDD voltage line is lowered to a threshold voltage level or less, and thus, in the embodiments of the present disclosure, by sensing the short circuit, the first and second VDD voltages may be controlled so as not to be supplied to the source drive ICs. Accordingly, in the embodiments of the present disclosure, when the second VDD voltage line is short-circuited to the ground, the second VDD voltage may be supplied at the ground voltage level, and the first VDD voltage may be supplied at a level similar to the ground voltage, thereby preventing the display panel from displaying an abnormal screen.

It will be apparent to those skilled in the art that various modifications and variations can be made in the present disclosure without departing from the scope of the disclosures. Thus, it is intended that the present disclosure covers the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A power supply unit for a display device, including:

a first voltage generator for generating a first voltage;

a first voltage line connected to the first voltage generator for supplying the first voltage to a plurality of first source drive ICs of the display panel;

a second voltage generator for generating a second voltage, the second voltage generator being separate from the first voltage generator;

a second voltage line connected to the second voltage generator for supplying the second voltage to a plurality of second source drive ICs of the display panel; and a diode circuit including a diode, the diode circuit being connected between the first voltage line and the second voltage line and configured to allow a current flow from the first voltage line to the second voltage line if a difference between the first voltage of the first voltage line and the second voltage of the second voltage line is greater than a first predetermined voltage.

2. The power supply unit according to claim 1, further comprising:

a third voltage generator for generating a third voltage that is less than the first voltage; and a third voltage line connected to the third voltage generator for supplying the third voltage to the first and the second source drive ICs of the display panel.

3. The power supply unit according to claim 2, wherein the third voltage generator is connected to the first voltage line and is configured to generate the third voltage using the first voltage.

4. The power supply unit according to claim 1, wherein the diode circuit includes at least two diodes connected to each other in series.

5. The power supply unit according to claim 4, wherein an anode electrode of a first diode of the at least two diodes connected in series is electrically connected to the first voltage line, and a cathode electrode of a last diode of the at least two diodes connected in series is connected to the second voltage line.

6. The power supply unit according to claim 1, wherein an anode electrode of the diode is electrically connected to the first voltage line and a cathode electrode of the diode is electrically connected to the second voltage line.

7. The power supply unit according to claim 1, further comprising:

a short circuit detector connected to the first voltage line and configured to output a short circuit detection signal indicating whether the first voltage is less than a second predetermined voltage; and a voltage output controller configured to control the first and second voltage generators based on the short circuit detection signal.

8. The power supply unit according to claim 7, wherein the voltage output controller controls the first and second voltage generators to stop an output of the first and second voltages, respectively, in response to the short circuit signal indicating that the first voltage is less than the second predetermined voltage.

9. A display device, including:

a display panel including a plurality of gate lines, a plurality of data lines, and a plurality of pixels formed at respective intersections of the gate lines and the data lines;

a data driver including a plurality of first source drive ICs and a plurality of second source drive ICs, the first and the second source drive ICs being configured to output data voltages to the plurality of data lines; and a power supply unit, including:

a first voltage generator for generating a first voltage;

a first voltage line connected to the first voltage generator for supplying the first voltage to the plurality of first source drive ICs;

a second voltage generator for generating a second voltage, the second voltage generator being separate from the first voltage generator;

a second voltage line connected to the second voltage generator for supplying the second voltage to the plurality of second source drive ICs; and at least one diode connected between the first voltage line and the second voltage line, the at least one diode allows a current flow from the first voltage line to the second voltage line if a difference between the first voltage of the first voltage line and the second voltage of the second voltage line is greater than a first predetermined voltage.

10. The display device according to claim 9, wherein the source drive ICs are configured to receive a third voltage and one of the first and the second voltage from the power supply unit.

11. The display device according to claim 10, wherein the source drive ICs include, respectively, an output buffer including at least one positive output buffer for outputting a positive data voltage and at least one negative output buffer for outputting a negative data voltage, wherein one of the first voltage and the second voltage is input to a first reference voltage terminal of the positive output buffer and the third voltage is input to a second reference voltage terminal of the positive output buffer.

12. The display device according to claim 9, wherein the power supply unit includes at least two diodes connected to each other in series between the first voltage line and the second voltage line.

13. The display device according to claim 12, wherein an anode electrode of a first diode of the at least two diodes connected in series is electrically connected to the first voltage line, and a cathode electrode of a last diode of the at least two diodes connected in series is connected to the second voltage line.

14. The display device according to claim 9, wherein the power supply unit further includes:

a short circuit detector connected to the first voltage line and configured to output a short circuit detection signal indicating whether the first voltage is less than a second predetermined voltage; and a voltage output controller configured to control the first and second voltage generators based on the short circuit detection signal.

15. The display device according to claim 14, wherein the voltage output controller controls the first and second voltage generators to stop an output of the first and second voltages, respectively, in response to the short circuit signal indicating that the first voltage is less than the second predetermined voltage.

16. The power supply unit according to claim 2, wherein the third voltage generator generates the third voltage based on the first voltage, and the second voltage is supplied to the plurality of second source drive ICs before the third voltage is supplied to the second source drive ICs.

17. The power supply unit according to claim 16, wherein the first voltage is supplied to the plurality of first source drive ICs before the second voltage is supplied to the plurality of second source drive ICs.

18. The display device according to claim 10, further comprising:

a gamma reference voltage supply unit configured to supply first and second gamma reference voltages to at least one of the first source drive ICs or the second source drive ICs, wherein the at least one of the first source drive ICs or second source drive ICs generates gamma grayscale voltages based on the first and second gamma reference voltages.

19. The display device of claim 18, wherein the at least one of the first source drive ICs or second source drive ICs includes a voltage divider circuit configured to generate the gamma grayscale voltages by voltage dividing the first and second gamma reference voltages.

20. The display device of claim 18, wherein the plurality of first source drive ICs receive the first voltage prior to receiving the third voltage, and the plurality of second source drive ICs receive the second voltage prior to receiving the third voltage.

* * * * *